US007559114B2

(12) United States Patent
Ranilovich

(10) Patent No.: US 7,559,114 B2
(45) Date of Patent: Jul. 14, 2009

(54) HINGE ATTACHABLE DOOR STOP INSERT

(76) Inventor: Anthony Ranilovich, 308 Arnold Ave., Pontiac, MI (US) 48341

( * ) Notice: Subject to any disclaimer, the term of this patent is extended or adjusted under 35 U.S.C. 154(b) by 526 days.

(21) Appl. No.: 11/432,144

(22) Filed: May 11, 2006

(65) Prior Publication Data

US 2007/0261207 A1 Nov. 15, 2007

(51) Int. Cl.
*E05F 5/02* (2006.01)

(52) U.S. Cl. ..... 16/82; 16/374; 292/288

(58) Field of Classification Search ..... 16/82, 16/319, 374, DIG. 17, 86 B; 292/288, 343, 292/DIG. 15, DIG. 17; 49/383
See application file for complete search history.

(56) References Cited

U.S. PATENT DOCUMENTS

| | | | | | |
|---|---|---|---|---|---|
| 1,616,265 | A | * | 2/1927 | Kroehling | 16/375 |
| 2,592,230 | A | * | 4/1952 | Allen | 16/223 |
| 2,638,620 | A | * | 5/1953 | Civitelli | 16/375 |
| 3,135,012 | A | * | 6/1964 | Wessel | 16/375 |
| 3,676,966 | A | | 7/1972 | Ragland | |
| 3,965,531 | A | | 6/1976 | Fox et al. | |
| 4,259,762 | A | * | 4/1981 | Civitelli | 16/86 B |
| 4,738,002 | A | * | 4/1988 | Shank | 16/82 |
| 4,831,688 | A | * | 5/1989 | Deininger | 16/319 |
| 4,858,273 | A | * | 8/1989 | Civitelli | 16/86 A |
| 5,027,471 | A | * | 7/1991 | Barnes | 16/86 R |
| 5,044,681 | A | | 9/1991 | Neighbors | |
| 5,369,840 | A | | 12/1994 | Salvador et al. | |
| 5,450,652 | A | * | 9/1995 | Webb | 16/82 |
| 5,509,233 | A | | 4/1996 | Peterson | |
| 5,560,080 | A | * | 10/1996 | Reed | 16/82 |
| 5,711,557 | A | | 1/1998 | Nicolosi | |
| 6,003,911 | A | | 12/1999 | Sowash | |
| 6,016,588 | A | | 1/2000 | Kamerschen | |
| 6,141,909 | A | | 11/2000 | Hanson | |
| 6,149,212 | A | | 11/2000 | Kuntz et al. | |
| 6,311,367 | B1 | | 11/2001 | Larsen | |
| 6,874,198 | B2 | | 4/2005 | Renaud | |
| 6,948,214 | B2 | | 9/2005 | Spalding et al. | |

FOREIGN PATENT DOCUMENTS

| | | |
|---|---|---|
| CA | 2438228 | 2/2005 |

* cited by examiner

*Primary Examiner*—William L. Miller
(74) *Attorney, Agent, or Firm*—Gifford, Krass, Sprinkle, Anderson & Citkowski, P.C.

(57) ABSTRACT

A door stop releasably secured to an upper edge location of a door hinge assembly to hold a door in an open position relative to a surrounding door jamb. The door stop includes a seating portion releasably securing over a top edge of a sleeve portion associated with a selected door hinge. A pair of notches are defined in angularly disposed fashion within an underside surface of the seating portion, the notches seat over proximate extending locations associated with first and second hinge plates integrally defined with spaced apart and overlapping cylindrical portions defining the door hinge sleeve. An outwardly flared portion extends integrally from the seating portion, opposite side edges associated with the outwardly flared portion respectively abut locations associated with an inner door edge and door jamb in order to hold open the door.

18 Claims, 1 Drawing Sheet

HINGE ATTACHABLE DOOR STOP INSERT

BACKGROUND OF THE INVENTION

The present invention relates generally to an insert for use in holding open a door. More specifically, the present invention discloses a clip-on style door stop insert, attachable over a top edge of a conventional door hinge, and seating relative to top edge locations associated with first and second hinge plates in turn connected to the inner door and fixed jamb. The insert further includes a pair of wedge shaped wings which, upon installation of the insert upon any of three selected hinge assemblies, hold the door in an open position.

DESCRIPTION OF THE PRIOR ART

The prior art is well documented with door stop mechanisms for the purpose of holding open a door. The most basic door stop is in the form of a triangular shaped and wedging article which sets upon a ground location and holds a door in an open position by engaging its bottom extending edge upon the upwardly angled wedge surface.

A shortcoming of such a conventional door stop article is that it requires that a supportable ground surface be located proximate to the swinging bottom edge of the door. Furthermore, the dimensions of the article must be appropriate to allow placement of the conventional wedge shaped door stopper in the manner desired and while retaining the required holding force, such as often is required against a biasing spring or other mechanism tending to influence the door in a closing position. Such articles are therefore useless in applications where a door in a swung open position is elevated any distance from a corresponding ground location.

Attempts have been made in the relevant art to overcome this remedy through the incorporation of a door stop article which is utilized with a given door hinge. A first example of this is set forth in U.S. Pat. No. 5,044,681, issued to Neighbors, and which teaches a door stop arrangement directed between a door frame and a door for positioning upon a hinge to effect maintaining the door in an opened configuration.

The door stop includes a "V" shaped body defined by a joinder line, the body further exhibiting an "L" shaped handle extending rearwardly of the body and bisecting an acute included angle between the plates defining the body to permit positioning of the "L" shaped handle overlying the hinge when the plates are directed between the door and the frame. A shortcoming associated with Neighbors focuses on the configuration and physics associated with the "L" shaped holding handle, and which appears not to provide a secure mounting platform for the device.

Canadian Patent No. 2 438 228, issued to Redden, teaches a door hinge stop designed to hold a manual, gravity or mechanically closing door in an open position. Two or more flanges are shaped into an angular configuration. As with Neighbors, an "L" shaped bracket is provided for generally engaging against a rear facing location of a door hinge.

U.S. Pat. No. 6,003,911, issued to Sowash, discloses a door stop block exhibiting an angular recessed surface defining angular faces positioned at an acute angle with respect to the stop surfaces. The stop block is configured to insert into the jamb when the door is opened and the angular faces engaged over the top corner of the hinge edge stile of the door to hold the door open. A handle is attached to the stop block for insertion and removal of the same.

U.S. Pat. No. 5,711,557, issued to Nicolosi, teaches a door stop for mounting on a door hinge and which exhibits an inverted U-shaped support and a base aligned substantially perpendicularly to the support. A single section of wire rod is formed and shaped in an inverted, U-shape fashion having first and second downwardly depending legs joined by a trough section. A substantially planar base is fixed to an end of the first leg of the support, a bottom of the base further being aligned in a plane substantially perpendicular to the plane of the support. The support is therefore adapted to being mounted on a hinge plate associated with the door hinge to maintain the door in an open position.

SUMMARY OF THE PRESENT INVENTION

The present invention discloses a door stop, releasably secured to an upper edge location of a door hinge assembly, and which is an improvement over known prior art devices for holding a door in an open position. The hinge assembly includes an assembleable and vertically extending sleeve, defining a vertical pivot axis from which extends first and second hinge plates securing, respectively, to an inner door edge and doorjamb.

A body of the hinge assembly is constructed of a durable material such as a nylon or polymer and includes a substantially cylindrical shaped seating portion such as apertured partially or entirely from an underside location, for releasably securing over a top edge of the hinge sleeve. A pair of recess notches are defined within underside and angled locations associated with a circumferentially extending wall of the seating portion. The notches seat over proximate extending locations associated with the first and second hinge plates, concurrent with the underside of the seating portion engaging over the corresponding top surface of the hinge sleeve.

An outwardly flared portion extends integrally from the seating portion, opposite side edges associated with the outwardly flared portion respectively abutting locations associated with the inner door edge and door jamb in order to hold open the door. The outwardly flared portion exhibits specified shape and size and may further include such as a generally triangular shape. The body exhibits in a preferred embodiment a substantially "Y" shaped outer body, a thin and planar shaped connecting and reinforcing portion extending between inner opposing and angled surfaces associated with the outwardly flared portion.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
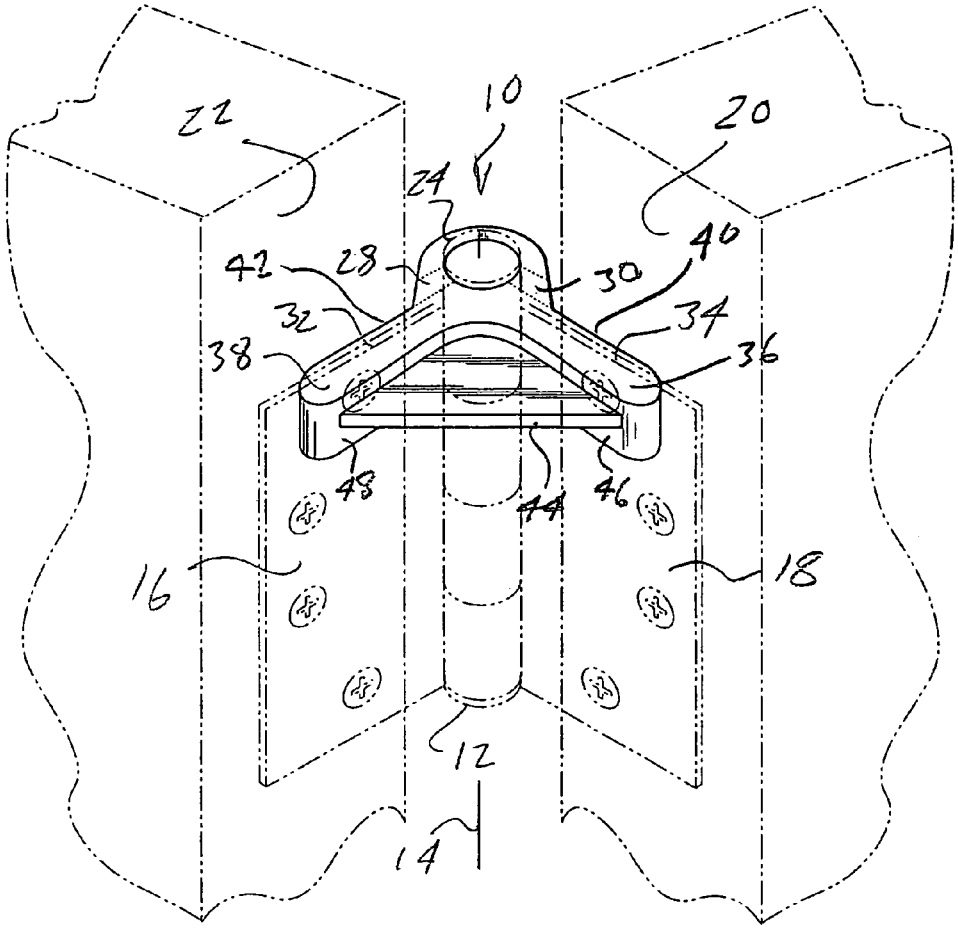
FIG. 1 is an environmental view illustrating the clip-on door stop inserted according to a preferred embodiment of the present invention.
Figure 2:
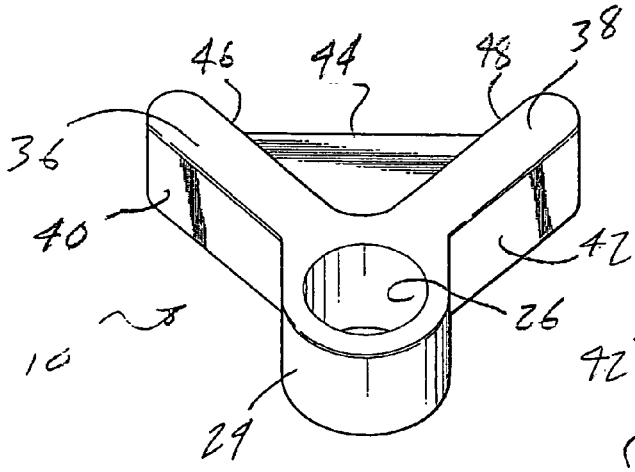
FIG. 2 is a first perspective view of the present design.
Figure 3:
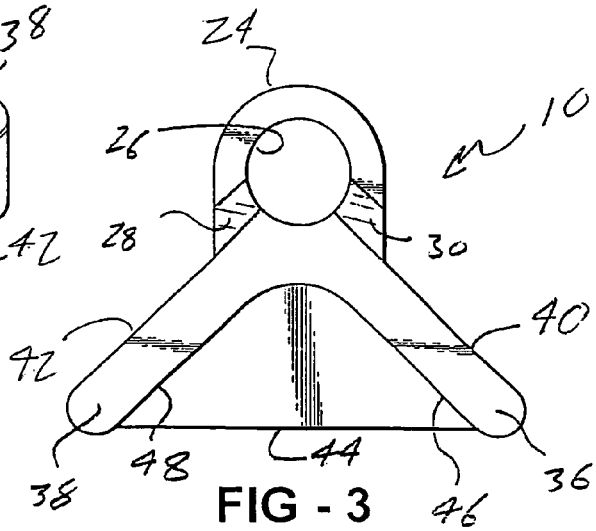
FIG. 3 is a further rotated view of the present design and which further illustrates the pair of underside defined and angled recess notches for seating over associated upper hinge plate edge locations extending from a cylindrical shaped door hinge according to the present invention.

Referring now to FIGS. 1-3, a door stop insert is illustrated at 10 according to a preferred embodiment of the present invention. As previously described, the door stop 10 releasably secures to an upper edge location of a door hinge assembly, and which is an improvement over known prior art devices for holding a door in an open position, such as in particular a door exhibiting a bottom edge a spaced or elevated location from a ground surface.

The hinge assembly, as known in the prior art, includes an assembleable and vertically extending sleeve 12 (see FIG. 1), defining a vertical pivot axis 14 from which extends first and second hinge plates 16 and 18. As is known in the art, the hinge plates 16 and 18 are integrally formed with spaced apart and overlapping cylindrical portions which assemble together to define the vertically extending sleeve 12 and in turn secure, respectively, to an inner door edge 20 and a door jamb 22.

A body of the hinge assembly 10 is constructed of a durable material, such as without limitation a nylon or polymer, and includes a substantially cylindrical shaped seating portion 24. The seating portion 24 is at least apertured partially from an underside location, but preferably exhibits an aperture (see inner circumferential wall 26) extending its height and such that the seating portion 24 releasably secures around and over a top edge of the hinge sleeve 12.

A pair of recess notches 28 and 30 (see as best shown in FIG. 3), are defined within underside and angled locations associated with a circumferentially extending wall of the seating portion 24. The notches 28 and 30 seat, as shown in FIG. 1, over proximate extending top edge locations associated with the first 16 and second 18 hinge plates (see further associated top edges at 32 and 34), concurrent with the underside (or inside) of the seating portion 24 engaging over the corresponding top surface of the hinge sleeve 12. As is shown, the angular orientation of the notches 28 and 30 establish in large measure the open angular orientation established between the inner door edge 20 and door jamb 22 (see again FIG. 1).

An outwardly flared portion exhibits a substantially "Y" shaped body with first 36 and second 38 legs extends integrally from the seating portion 24. Opposite and outer side edges 40 and 42 associated with the outwardly flared leg portions 38 and 40, respectively abut locations associated with the inner door edge 20 and door jamb 22 (again FIG. 1) in order to hold open the door.

The outwardly flared portion exhibits a specified shape and size, as illustrated, and may further include such as a generally triangular shape in outer profile as well as other potential shapes or configurations consistent with providing open abutting support between a door and jamb. As shown in the embodiment illustrated, a thin and planar shaped connecting and reinforcing portion 44 (as shown substantially triangular in shape) extends between inner opposing and angled surfaces 46 and 48 associated with the outwardly flared portion. The configuration of the reinforcing portion 44 is an optional aspect of the present design and may be resized or shaped according to considerations such as material savings and the like.

Having described my invention, other and additional preferred embodiments will become apparent to those skilled in the art to which it pertains. In particular, the present design can be resized or reconfigured as required by a size of a given door/hinge assembly or placeable in individual or plural fashion with any of a number of pivotally aligning hinges (e.g. three or more).

I claim:

1. A door stop releasably secured to an upper edge location of a door hinge assembly, the hinge assembly including an assembleable and vertically extending sleeve defining a vertical pivot axis from which extends first and second hinge plates securing, respectively, to an inner door edge and door jamb, said door stop comprising:

a three-dimensional shaped body including a seating portion releasably securing over a top edge of the hinge sleeve, and proximate upper edge locations associated with the first and second hinge plates;

said seating portion exhibiting a generally cylindrical shape and further comprising a pair of angularly disposed recess notches defined at first and second underside locations and seating over the upper edge locations associated with the first and second hinge plates; and an outwardly flared portion extending integrally from said seating portion, opposite side edges associated with said outwardly flared portion respectively abutting locations associated with the inner door edge and door jamb in order to hold open the door.

2. The door stop as described in claim 1, said outwardly flared portion having a specified shape and size and further comprising a generally triangular shape.

3. The door stop as described in claim 1, said door stop exhibiting a specified shape and size and further comprising at least one of a nylon or plasticized material.

4. The door stop as described in claim 1, further comprising a generally circular shaped aperture formed at a third underside location associated with said seating portion.

5. The door stop as described in claim 4, further comprising said aperture extending entirely through said circular shaped seating portion.

6. The door stop as described in claim 1, said body exhibiting a specified shape and size and further comprising a substantially "Y" shaped said outwardly flared portion, a thin and planar shaped connecting and reinforcing portion extending between inner opposing and angled surfaces associated with said outwardly flared portion.

7. A door stop releasably secured to an upper edge location of a door hinge assembly, the hinge assembly including an assembleable and vertically extending sleeve defining a vertical pivot axis from which extends first and second hinge plates securing, respectively, to an inner door edge and door jamb, said door stop comprising:

a three-dimensional shaped body including a substantially cylindrical shaped seating portion releasably securing over a top edge of the hinge sleeve;

a pair of recess notches defined within underside and angled locations associated with a circumferentially extending wall of said seating portion, said notches seating over proximate extending locations associated with the first and second hinge plates concurrent with said underside of said seating portion engaging over the top edge of the hinge sleeve; and an outwardly flared portion extending integrally from said seating portion, opposite side edges associated with said outwardly flared portion respectively abutting locations associated with the inner door edge and door jamb in order to hold open the door.

8. The door stop as described in claim 7, said outwardly flared portion having a specified shape and size and further comprising a generally triangular shape.

9. The door stop as described in claim 7, said door stop exhibiting a specified shape and size and further comprising at least one of a nylon or plasticized material.

10. The door stop as described in claim 7, further comprising a generally circular shaped aperture formed said underside of said seating portion.

11. The door stop as described in claim 10, further comprising said aperture extending entirely through said cylindrical shaped seating portion.

12. The door stop as described in claim 7, said body exhibiting a specified shape and size and further comprising a substantially "Y" shaped said outwardly flared portion, a thin and planar shaped connecting and reinforcing portion extending between inner opposing and angled surfaces associated with said outwardly flared portion.

13. A door stop releasably engaging upon a door hinge assembly to hold a door in an open position relative to a surrounding door jamb, comprising:

a three-dimensional shaped body including a seating portion releasably securing over a top edge of a sleeve portion associated with said door hinge assembly;

a pair of notches defined in angularly disposed fashion within an underside surface of said seating portion, said notches seating over proximate extending locations associated with first and second hinge plates integrally defined with spaced apart and overlapping cylindrical portions defining the door hinge sleeve; and an outwardly flared portion extending integrally from said seating portion, opposite side edges associated with said outwardly flared portion respectively abutting locations associated with an inner door edge and door jamb in order to hold open the door.

14. The door stop as described in claim 13, said outwardly flared portion having a specified shape and size and further comprising a generally triangular shape.

15. The door stop as described in claim 13, said door stop exhibiting a specified shape and size and further comprising at least one of a nylon or plasticized material.

16. The door stop as described 13, further comprising a generally circular shaped aperture formed in an at least an underside location associated with said seating portion.

17. The door stop as described in claim 16, further comprising said aperture extending entirely through said circular shaped seating portion.

18. The door stop as described in claim 13, said body exhibiting a specified shape and size and further comprising a substantially "Y" shaped said outwardly flared portion, a thin and planar shaped connecting and reinforcing portion extending between inner opposing and angled surfaces associated with said outwardly flared portion.

* * * * *